United States Patent [19]

John

[11] 4,047,270

[45] Sept. 13, 1977

[54] APPARATUS FOR SEPARATING OBJECTS

[75] Inventor: Heinz John, Berneck, Switzerland

[73] Assignee: Lindauer Dornier Gesellschaft mbH., Germany

[21] Appl. No.: 495,087

[22] Filed: Sept. 4, 1974

[51] Int. Cl.[2] ..... D03J 1/14; B66C 1/02

[52] U.S. Cl. ..... 28/205; 214/1 BT

[58] Field of Search ..... 28/46; 112/104; 214/1 BH, 1 BT

[56] References Cited

U.S. PATENT DOCUMENTS

| | | | |
|---|---|---|---|
| 1,171,388 | 2/1916 | Field | 28/46 |
| 2,313,433 | 3/1943 | Golden | 112/104 |
| 2,512,165 | 6/1950 | Meier | 28/46 |
| 2,777,408 | 1/1957 | Beck | 112/104 |
| 3,293,722 | 12/1966 | Huffman et al. | 28/46 |
| 3,744,109 | 7/1973 | Dohi et al. | 28/46 |
| 3,857,496 | 12/1974 | Gonzales | 214/1 BT |

*Primary Examiner*—Louis K. Rimrodt
*Attorney, Agent, or Firm*—James E. Bryan

[57] ABSTRACT

This invention relates to an apparatus for separating objects, particularly for drawing-off individual heddles from a pack, comprising substantially U-shaped, pivotal, reciprocatable pipe means adapted to be mounted adjacent a pack of heddles and to contact a heddle with the end thereof in the working position thereof, and means for creating a partial vacuum in said pipe means.

1 Claim, 4 Drawing Figures

APPARATUS FOR SEPARATING OBJECTS

The present invention relates to an apparatus for separating objects, particularly for drawing off or lifting off individual heddles or laminae guided on heddle-carrying rails and combined into packs.

Such apparatuses are preferably employed for separating the heddles in warp draw-in machines for looms. With the aid thereof, the heddles combined on weaving shafts to a tightly packed group or row, and being joined together may be separated and lifted off of each other. The heddles that are thereby guided off and separated pass into or reach in this manner a predetermined draw-in position, whereby the ear or eye for pulling the thread through is brought into the position required therefor. As a result, it is possible to determine the textile pattern which is produced with the threads being disposed on the tree.

Known in such a separating apparatus from U.S. Pat. Nos. 2,175,910 and 3,103,056, and from Swiss Pat. No. 485,056. In the apparatus disclosed in the last-mentioned patent, which refers back to the two patents mentioned first hereinabove, a worm near the end of the pack is rotatably positioned about an axis parallel to the path of movement of the objects in question. The worm is divided into a helical groove which receives an object or a heddle and advances it during rotation in the direction of rotation along the worm. Thereby the object or the heddle passes into or arrives in the spiral and in the groove corresponding to the heddle width, wherein the heddle is rotated into the position for the thread reception and subsequently released.

Also known in the art from German Offenlegungsschrift No. 2,228,690, is an apparatus for separating heddles in which the individual heddles are electromagnetically lifted off of each other rather than with the aid of the permanent magnets heretofore used, and the apparatus also comprises control members being so provided for that they will supply to the electromagnet in the introductory phase of its movement facing away from the heddle row a relatively weak magnetizing current, and in the following phase of the direction of movement a relatively strong magnetizing current.

All of these known separating apparatuses or devices have the common disadvantage that either they are expensive in the manufacture thereof and are provided only with special heddles having a particular configuration of the eyelets necessary for the thread reception (for example the apparatus known from the first-named U.S. patents and the Swiss patents), or that the simultaneous drawing-in of heddles is possible only in small numbers (maximally two heddles), (such as is the case, for example, in the prior art apparatus known from the last-mentioned German Offenlegungsschrift).

It is the object of the present invention to provide an apparatus with the aid of which it is possible to carry out the simultaneous pulling or drawing-in of heddles in a large number thereof, while the structural elements are limited to a minimum compared to that customary heretofore.

This object is obtained, in accordance with the present invention, by virtue of the fact that the drawing and lifting of individual heddles or lamellae off of the pack is carried out primarily by means of suction nozzles known per se, wherein the suction nozzles are mounted at the pipe ends of pipes being pivotal about the axes thereof and bent so as to be U-shaped, and wherein the conveyance of the suctioned-off heddles or lamellae via the heddle-carrying rails into the drawing-in position thereof takes place secondarily by displaceable magnetic means mounted behind the suction nozzles.

In a further embodiment of the present invention, the suction nozzles are simultaneously provided as suction nozzle magnets adapted to be adjusted or coordinated to heddles. The magnets are advantageously provided either as permanent magnets known per se, or as electromagnets.

The advantage afforded by the present invention resides particularly in that the drawing-in of heddles and of lamellae can take place simultaneously and in a plurality thereof (corresponding to the number of weaving shafts being employed) without any additional structural elements, and in that the apparatus, because of the same structural parts being present, is easily assembled and disassembled for maintenance. What is involved here than are pipes adapted to be pivoted about the axes thereof and connected to a suction pump, which pipes are disposed symmetrically on both sides of the axis of the heddles being tightly or closely joined together in a row to form a pack on weaving shafts of the harness placed ahead of the draw-in machine, and said pipes being bent-off in a U-shaped manner at the part ends projecting beyond the pack.

Mounted at the bent-off parallel ends of the pipes facing the heddles are suction nozzles with series-connected displaceable magnets, or a combination of suction nozzles and magnets, which are connected with the rotatable pipes and which, after pivoting into the operative position, will rest equally symmetrically on both sides of the thread eyelets closely against the plane and flat partial heddle elements positioned between the thread eyelets and the two guiding eyelets arranged at the upper and the lower heddle ends. When the suction pump is operated, the heddles are individually lifted off of the pack, initially due to the suction effect created at the suction nozzles, and, in case of a combined construction of suction nozzles and magnets, by reason of the magnetic flux adjusted or adapted to the weight of the heddle and to the friction prevailing between the heddle-carrying rails and the guiding eyelets. After traversing a distance of the heddles from the pack, predetermined equally according to the weight of the heddles and the friction prevailing in the heddle-carrying rails, the transport or conveyance of the individual heddles into the threading position thereof is assumed by the stronger permanent magnets or electromagnets which are displaceably series-connected to the suction nozzles and the suction nozzle magnets. Hence the velocity at which the individual heddles may be moved into the predetermined threading position thereof is controllable by the symmetrically effected frequency of the pivoting movement of the U-shaped pipe ends, of the suctioning, and of the magnetizing operations (in case of the use of electromagnets). The heddles are gripped from the front without friction, and varying thicknesses and any possible deformations of the individual heddles remain without influence upon the course of the movement. Accordingly, the splined shafts, the worms, and separating knives heretofore required for drawing-off individual heddles are no longer needed.

One embodiment according to the present invention will now be further described hereinafter on the basis of and with reference to the accompanying drawings, wherein FIG. 1 is a partial side view of the arrangement of a separating device in a harness with a weaving heddle pack guided in weaving shafts;

Figure 1:
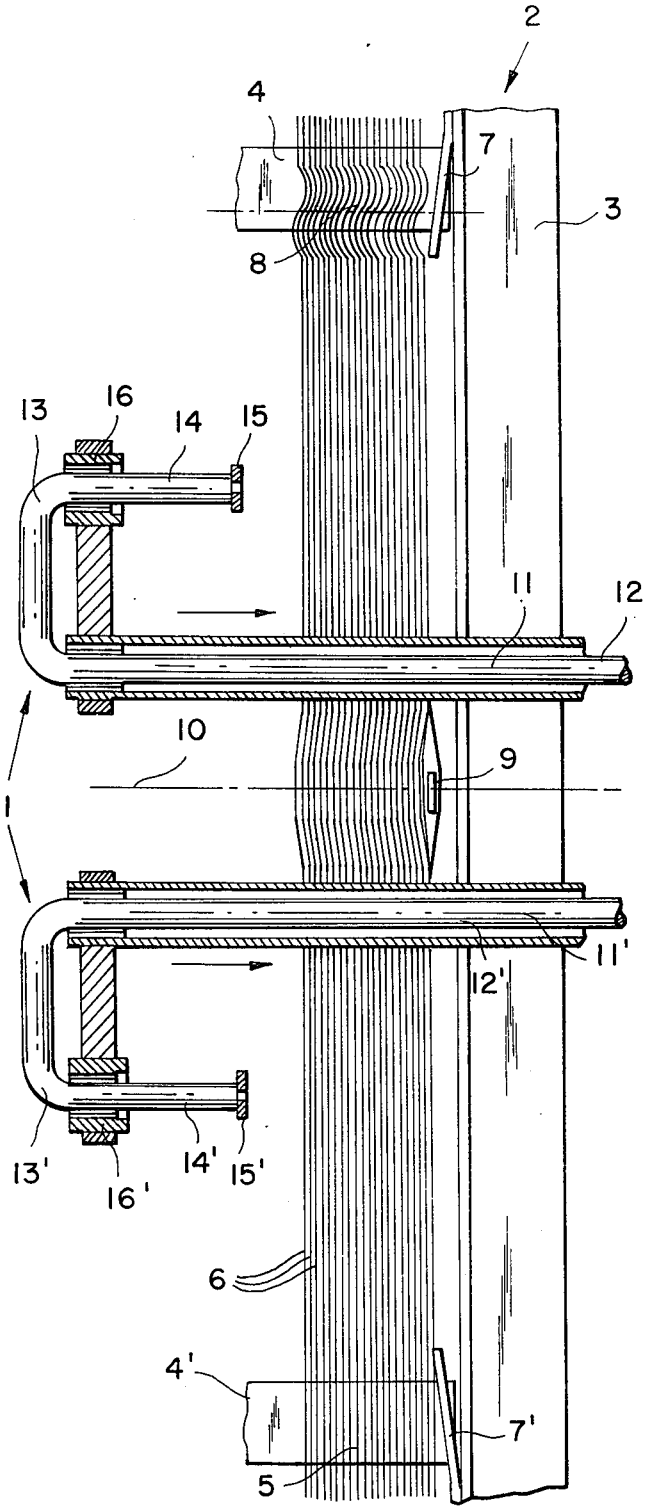

Shown in FIG. 1 in a partial side view is the arrangement or provision of a separating apparatus or device 1 in the position of rest and in the beginning operative position thereof (see the directional arrow). Mounted on a partially illustrated weaving harness 2 and shaft frame 3 are the heddle-carrying rails 4 and 4', suspended on which latter are individual heddles 6 combined to a pack 5, and which lean against the shaft frame 3 and against the spring lobes 7 and 7'. The heddles 6 suspended and guided in the heddle-carrying rails 4 and 4' are secured at the upper ends thereof against a premature twisting by means of a safety means 8 guarding against torsion. Arranged symmetrically to the axis 10 extending through the heddle thread eyelets 9 are the pipes 12 and 12' being pivotal through a distance X (FIG. 2) about the axes 11 and 11' thereof, which pipes are bent-off in a U-shape at the ends 13 and 13' projecting beyond the pack 5. Mounted at the pipe ends 14 and 14' which face the heddles 6 and which are parallel with respect to each other and to the axis 10 are the suction nozzles and suction nozzle magnets 15 and 15' and coordinated thereto are the magnetic means 16 and 16'. If necessary, the suction nozzles 15 and 15' also may be provided as permanent magnets or electromagnets (15 and 15').

Figure 2:
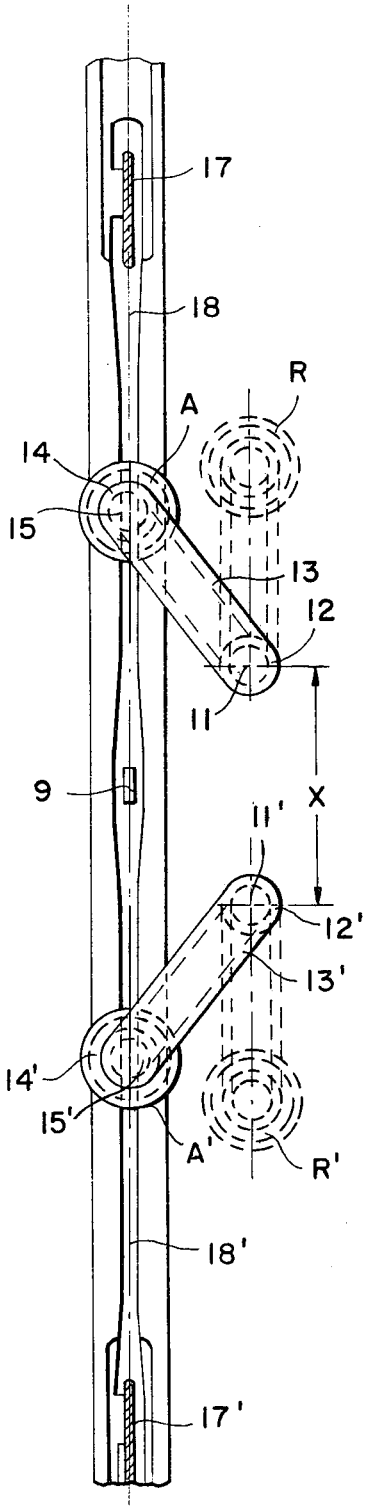
FIG. 2 shows the arrangement or provision of the separating device according to FIG. 1 in a front view.

FIG. 2 is a front view of the arrangement of the separating apparatus or device 1 shown in FIG. 1. Apparent therefrom are the two pipes 12 and 12' symmetrically mounted with respect to the axis 10 and rotatable about the axes 11 and 11' thereof, with the U-shaped bent-off ends 13 and 13' and the suction nozzles and suction nozzle magnets 15 and 15' mounted at the pipe ends 14 and 14' in the operative position and position of rest A, A' and R, R', respectively. In the operative position A, A', the suction nozzles and suction nozzle magnets 15 and 15' are likewise positioned symmetrically to the axis 10 and to the heddle thread eyelet 9 closely against the plane and flat partial heddle parts or elements 18 and 18' between the thread eyelet 9 and the guiding eyelets 17 and 17'.

Figure 3:
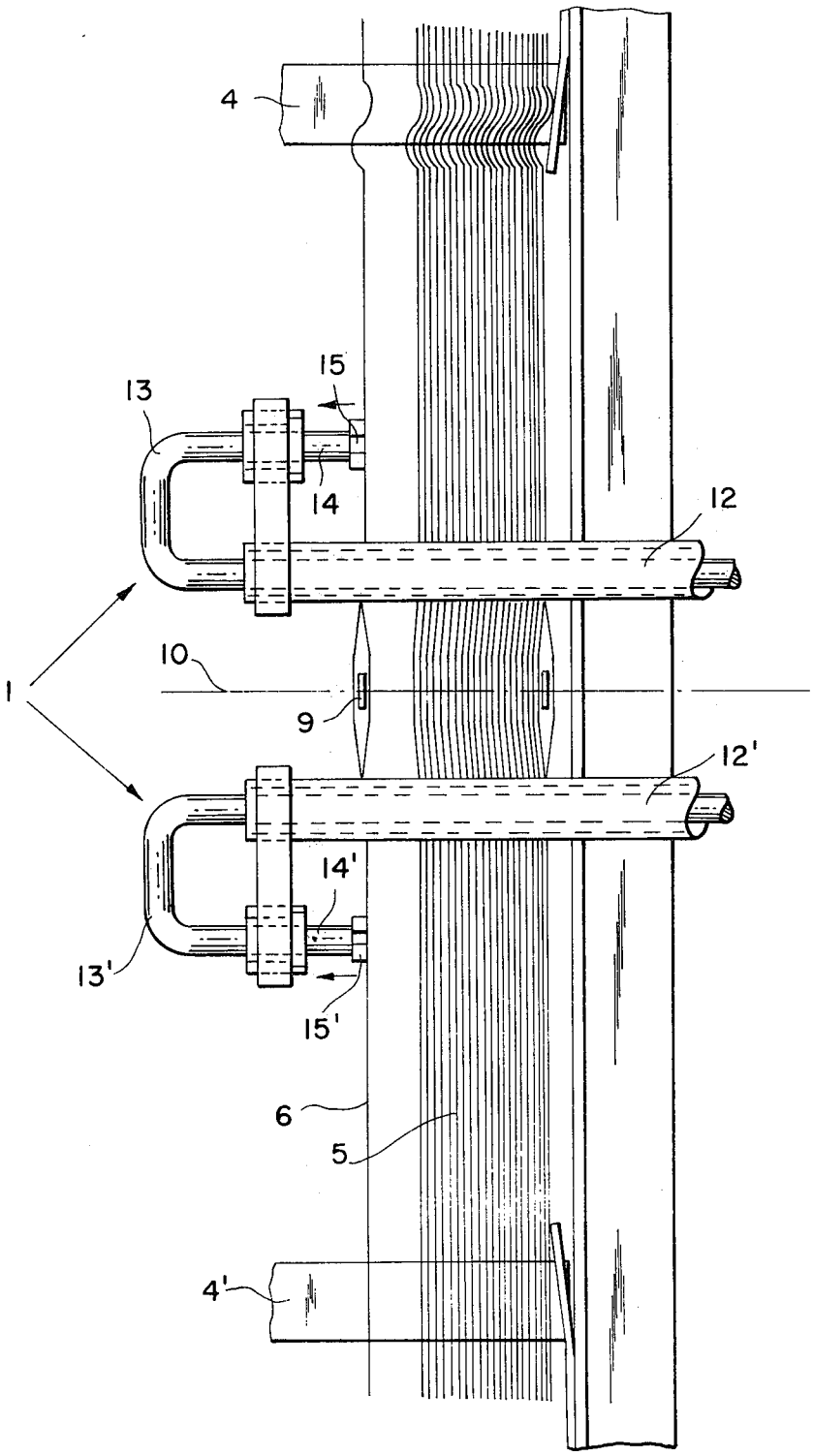
FIG. 3 illustrates the arrangement or provision of the separating device according to FIG. 1 in the draw-off position.

Shown in FIG. 3 is the construction of the separating apparatus 1 in the draw-off and operative position thereof. By operating a suction pump (not shown in this figure), one of the heddles 6 is lifted off of the pack 5 (see the directional arrow) by means of the suction effective in the pipes 12 and 12', the U-shaped ends 13 and 13', the mutually parallel pipe ends 14 and 14', and the suction nozzles and suction nozzle magnets 15 and 15' mounted thereon, and by virtue of the magnetic flux attuned to the heddle weight and to the friction prevailing between the heddle-carrying rails 4 and 4' and the guiding eyelets 17 and 17' (FIG. 2). At that time, the thread eyelet 9 of the heddle 6 is rotated about 90° as compared to its position of rest and its starting position in the axis 10.

Figure 4:
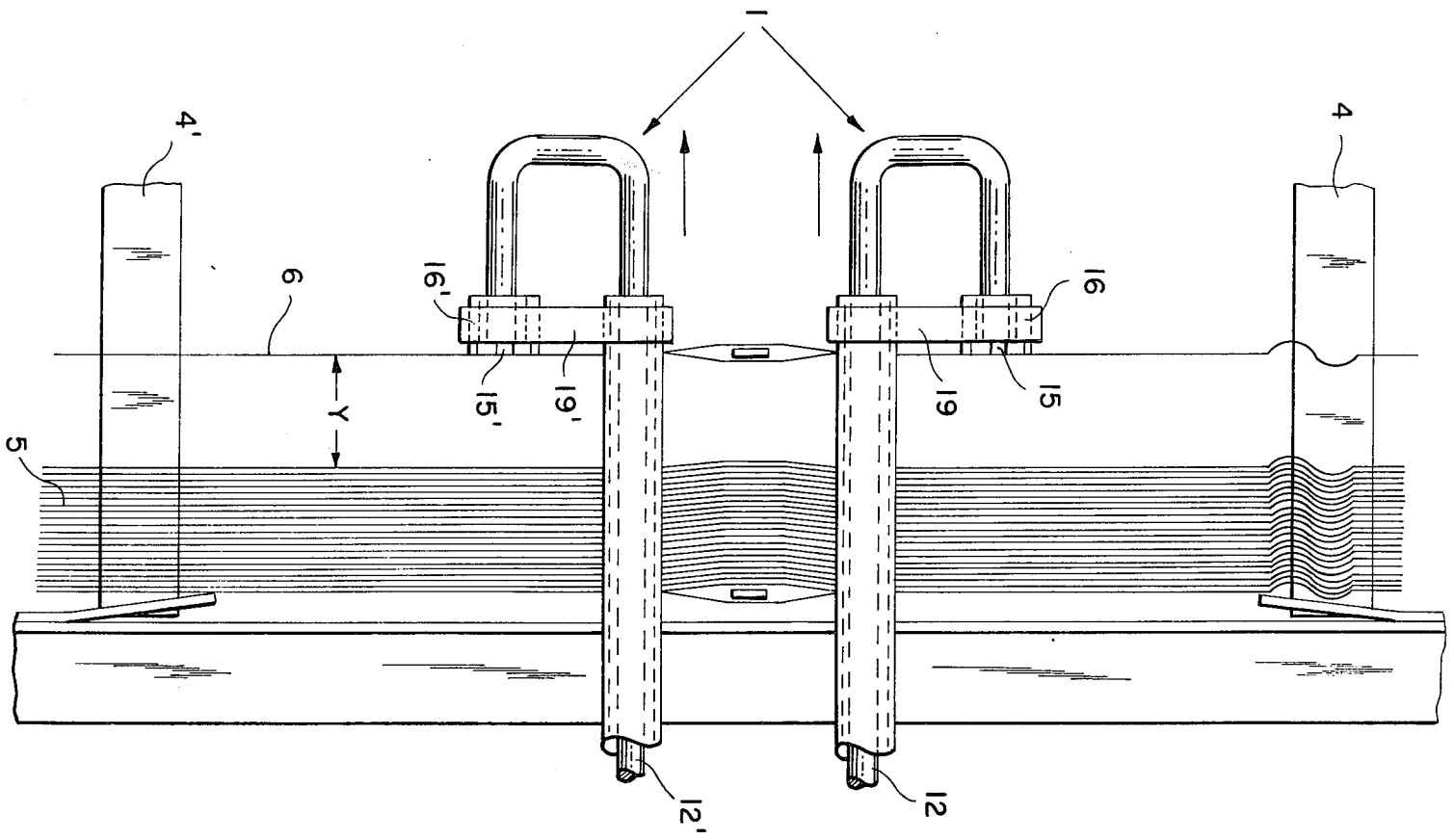
FIG. 4 illustrates the provision of the separating device according to FIGS. 1 and 3 in the transporting position thereof.

Apparent in the arrangement of the separating apparatus 1 as shown in FIG. 4 is the course of development of movement — advanced as compared to FIGS. 1 and 3 — of the heddle 6 having been lifted off of the pack 5 by the suction nozzles and the suction nozzle magnets 15 and 15'. In this case, the heddle 6 has reached the distance Y from the pack 5, this distance being predetermined by the weight of the heddle and by the friction prevailing in the heddle-carrying rails 4 and 4'. At the same time the pipes 12 and 12' have moved in the direction of the arrow, whereupon the suction nozzles and the suction nozzle magnets 15 and 15' mounted thereon have reached the magnetic means 16 and 16' which are series-connected therewith, connected via the guides 19 and 19', and provided each — as necessary — as permanent magnets or as electromagnets. The strong magnetic forces effective in these magnetic means relative to the small magnetic flux of force at the suction nozzles and suction nozzle magnets 15 and 15', and required merely for lifting individual heddles 6 off of the pack 5, guide the heddle 6 securely to the threading position thereof (equally in the direction of the arrow). After the thread pull-in operation is completed, the U-shaped ends 13 and 13' with the suction nozzles 15 and 15' provided thereon and the magnetic means 16 and 16' are pivoted back and arrive, by a pulling movement, once more in the starting position thereof so as to then begin anew with the separating and drawing-off movement (see also the direction of the arrow in FIG. 1).

It will be obvious to those skilled in the art that many modifications may be made within the scope of the present invention without departing from the spirit thereof, and the invention includes all such modifications.

What is claimed is:

1. An apparatus for separating objects, particularly for drawing off individual heddles from a pack, comprising two substantially U-shaped, pivotal, reciprocatable pipe means adapted to be mounted adjacent a pack of heddles and to contact a heddle with the end thereof in the working position thereof, magnetic means slidably mounted on said pipe means, and means for creating a partial vacuum in said pipe means.

* * * * *